US006481094B1

(12) United States Patent
Ikeda et al.

(10) Patent No.: US 6,481,094 B1
(45) Date of Patent: Nov. 19, 2002

(54) METHOD OF MANUFACTURING CHIP PTC THERMISTOR

(75) Inventors: Takashi Ikeda, Osaka (JP); Kiyoshi Ikeuchi, Nishinomiya (JP); Koichi Morimoto, Sakai (JP); Junji Kojima, Hirakata (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/508,062

(22) PCT Filed: Jul. 7, 1999

(86) PCT No.: PCT/JP99/03660

§ 371 (c)(1),
(2), (4) Date: Apr. 21, 2000

(87) PCT Pub. No.: WO00/03402

PCT Pub. Date: Jan. 20, 2000

(30) Foreign Application Priority Data

Jul. 8, 1998 (JP) ..... 10-192543

(51) Int. Cl.[7] ..... H01C 7/02

(52) U.S. Cl. ..... 29/612; 29/610.1; 29/620; 29/411; 338/22 R; 338/225 D

(58) Field of Search ..... 338/22 R, 225 D, 338/332, 328, 312; 29/610.1, 611, 612, 412, 623, 620, 621.1, 25.35, 411

(56) References Cited

U.S. PATENT DOCUMENTS 4,426,633 A * 1/1984 Taylor ..... 338/25
H415 H * 1/1988 Newnham ..... 338/22 R
4,766,409 A * 8/1988 Mandai ..... 338/22 R
5,077,889 A * 1/1992 Matsuda et al. ..... 29/612
5,228,188 A * 7/1993 Badihi et al. ..... 29/623
5,245,309 A * 9/1993 Kawase ..... 338/22 R
5,351,390 A * 10/1994 Yamada et al. ..... 29/612
5,488,348 A * 1/1996 Asida ..... 338/22 R
5,831,510 A * 11/1998 Zhang et al. ..... 338/22 R
5,963,416 A * 10/1999 Honda et al. ..... 361/306.1
6,188,308 B1 * 2/2001 kojima et al. ..... 338/22 R
6,292,088 B1 * 9/2001 Zhang et al. ..... 338/22 R

FOREIGN PATENT DOCUMENTS

JP 61-10203 * 1/1986
JP 04346409 * 12/1992
JP 9-503097 3/1997
JP 9-199302 7/1997

* cited by examiner

*Primary Examiner*—Carl J. Arbes
*Assistant Examiner*—Minh Trinh
(74) *Attorney, Agent, or Firm*—Parkhurst & Wendel, L.L.P

(57) ABSTRACT

A method of manufacturing a chip PTC thermistor utilizes a piece of conductive polymer having a PTC characteristic and metal foils formed by patterning and provided on the upper and the lower sides of the piece under pressure integrally into a sheet, making a hole part in the sheet, applying a protective coating serving as plating resist to upper and lower sides of the sheet, forming an electrode on the sheet by electroplating, and cutting the sheet into a chip. The protective coating is made of a material applicable at a temperature equal to or lower than the melting point of the conductive polymer. The processing temperatures at the step from the step of making a hole part in the sheet to the pre-processing step of the step of forming an electrode by electroplating on the sheet are not above the melting point of the conductive polymer.

13 Claims, 17 Drawing Sheets

METHOD OF MANUFACTURING CHIP PTC THERMISTOR

FIELD OF THE INVENTION

The present invention relates to a method of manufacturing a chip positive temperature coefficient (hereinafter referred to as "PTC") thermistor using electrically conductive polymer having a PTC characteristic.

BACKGROUND OF THE INVENTION

A PTC thermister composed of electrically conductive polymer is used as an overcurrent protective element in a variety of electronic devices. An operating principle is such that the electrically conductive polymer having a PTC characteristic heats up by itself when an excessive current flows in an electric circuit, changing a resistance of its own into a high value due to a thermal expansion of the electrically conductive polymer, thereby attenuating the current into a safe minute region.

A PTC thermistor of the prior art will be described hereinafter.

Japanese Patent Laid-open Publication, No. H09-503097 discloses an example of a chip PTC thermistor of the prior art. It is a chip PTC thermister comprising a PTC element having a through-hole penetrating between a first surface and a second surface, and first and second conductive members in a layer form, positioned inside of the through-hole, and connected physically as well as electrically to the first surface and the second surface of the PTC element.

FIG. 15(*a*) is a sectional view illustrating a chip PTC thermistor of the prior art, and FIG. 15(*b*) is a plan view of the same. In FIG. 15, a reference numeral 81 represents an electrically conductive polymer having a PCT characteristic, reference numerals 82*a*, 82*b*, 82*c*, and 82*d* represent electrodes composed of metallic foil, and reference numerals 83*a* and 83*b* represent through-holes. Reference numerals 84*a* and 84*b* are conductive members formed by plating on insides of the through-holes and over the electrodes 82*a*, 82*b*, 82*c*, and 82*d*.

A method of manufacturing the abovedescribed chip PTC thermistor of the prior art will be described with reference to FIGS. 16(*a*) through 16(*d*) and FIGS. 17(*a*) through 17(*c*) which are procedural drawings showing a method of manufacturing the chip PTC thermistor of the prior art.

First, polyethylene and carbon as electrically conductive particles are blended, and a sheet 91 shown in FIG. 16(*a*) is formed. Next, the sheet 91 is sandwiched with two metallic foils 92, as shown in FIGS. 16(*b*) and 16(*c*), and an integrated sheet 93 is formed by thermal-compression molding.

Next, through-holes 94 are perforated in a regularly arranged pattern on the integrated sheet 93, as shown in FIG. 16(*d*), after it is irradiated with an electron beam. A plated film 95 is then formed on the insides of the through-holes 94 and on the metallic foils 92, as shown in FIG. 17(*a*).

Etched grooves 96 are formed next in the metallic foils 92, as shown in FIG. 17(*b*).

The laminated product is now cut into individual pieces along cutting lines 97 of a longitudinal direction and cutting lines 98 of a lateral direction as shown in FIG. 17(*b*), to complete manufacturing of a chip PTC thermistor 99 of the prior art as shown in FIG. 17(*c*).

However, there has been a problem as described hereinafter with the conventional method of manufacturing the chip PTC thermistor, when a protective coating is formed on the plated film 95 for the purpose of preventing a short circuit and the like.

That is, formation of the protective coating needs to be carried out only after a pattern is formed by etching the metallic foil 92. Therefore, the protective coating is formed by screen-printing and thermally curing an epoxy base resin, after etched grooves are formed in the metallic foil 92. The problem occurs in this process that a crack may develop in the plated film 95 formed in the through holes 94 due to a mechanical stress generated by thermal expansion because of the heat applied when thermally curing the sheet 91.

It is conceivable to use a method wherein the etched grooves 96 are formed in the metallic foil, the protective coating is formed next, and the plated film 95 is formed thereafter, in order to prevent the crack from developing in the plated film 95. However, a problem has yet remained unresolved that the plated film 95 can not be formed uniformly on inner surfaces of the through-holes 94 in this method. It is presumed that this is because a surface of the sheet 91 loses an electric conductivity, as a result of the heat during the thermal setting of the protective coating, which causes polyethylene element in the sheet 91 to migrate toward the surface of the sheet 91 exposed on the inner surfaces of the through-holes 94.

An object of the present invention is to solve the foregoing problem of the prior art method, and to provide a method of manufacturing a chip PTC thermistor having superior reliability of connection, as it does not cause a crack in the electrode connecting between upper and lower electrodes when the protective coating is formed on the metallic foil, and it is capable of uniformly forming a film by electrolytic plating even on a portion of the electrically conductive polymer on an inner surface of the opening when the electrode is formed.

SUMMARY OF THE INVENTION

A method of the present invention for manufacturing a chip PTC thermistor comprises includes the steps of;

- forming a sheet by sandwiching an upper surface and a lower surface of an electrically conductive polymer having a PTC characteristic with metallic foils, on which a pattern is formed in advance, and integrating them by thermal-compression molding;
- providing an opening in the integrated sheet;
- forming a protective coating, also serving as plating resist, on an upper and lower surfaces of the sheet in which the opening is provided;
- forming an electrode by electrolytic plating on the sheet on which the protective coating serving also as plating resist is formed; and
- cutting the sheet, on which the electrode is formed, into individual pieces.

In addition, a material that is capable of being formed at a temperature below a melting point of the electrically conductive polymer is used for a material of the protective coating, also serving as plating resist, in the step of forming the protective coating also serving as plating resist. Furthermore, a processing temperature is maintained in such a manner as not to exceed the melting point of the electrically conductive polymer in each step of the preparatory processes from the step of providing the opening in the integrated sheet, up to the step of forming the electrode by electrolytic plating on the sheet, on which the protective coating serving also as plating resist, is formed. The manufacturing method of the present invention provides the chip PTC thermistor having a superior reliability of connection, since it does not cause a crack in the electrode formed by electrolytic plating, and is capable of uniformly forming a film of the electrolytic plating even on the portion of the electrically conductive polymer on the inside surface of the opening when the electrode is formed. In addition, the present invention can eliminate waste liquid that is otherwise produced if wet patterning is used for the metallic foil in the process of manufacturing the chip PTC thermistor, since the present method uses the metallic foil patterned in advance by die-cutting to manufacture the integrated sheet.

BRIEF DESCRIPTION OF THE DRAWINGS

FIG. 1(*b*) is a sectional view taken along a line A–A' in FIG. 1(*a*);

FIG. 7(*b*) is a sectional view taken along a line B–B' in FIG. 7(*a*);

FIG. 14(*b*) is another graph showing a thickness of electrode when manufactured without providing a plating resist for masking;

FIG. 15(*b*) is a plan view of the chip PTC thermistor of the prior art;

DETAILED DESCRIPTION OF PREFERRED EMBODIMENTS FIRST EXEMPLARY EMBODIMENT

A chip PTC thermistor and a method of manufacturing the same in a first exemplary embodiment of this invention will be described hereinafter, by referring to the accompanying figures.

Figure 1:
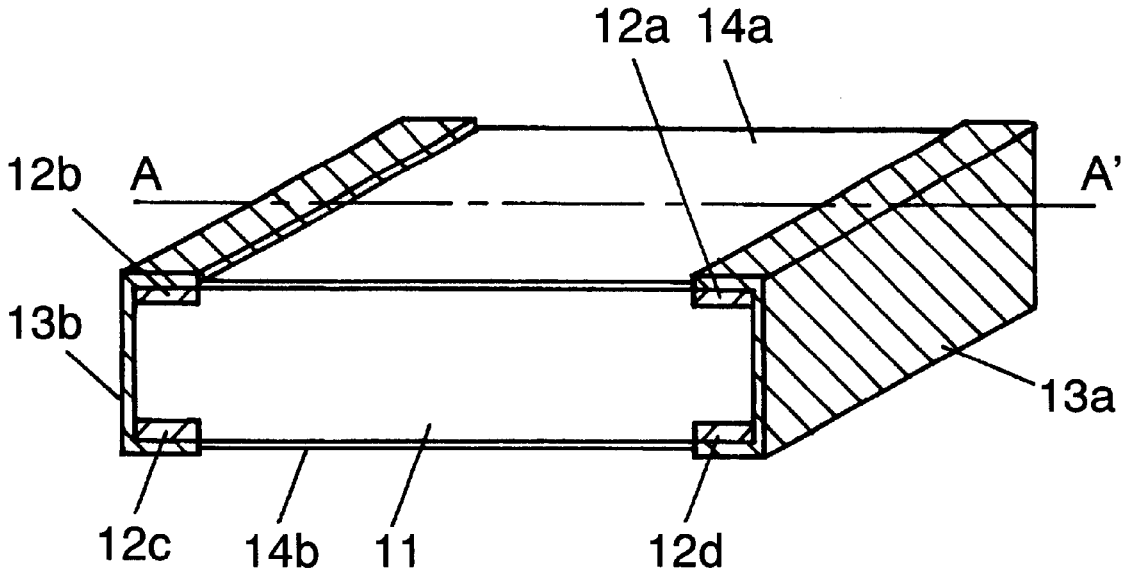
FIG. 1(*a*) is a perspective view of a chip PTC thermistor in a first exemplary embodiment of the present invention.
Figure 1:
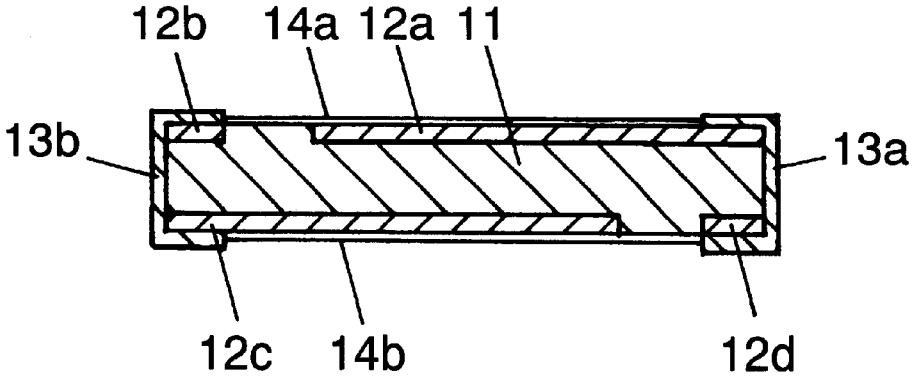
Figure 2A:
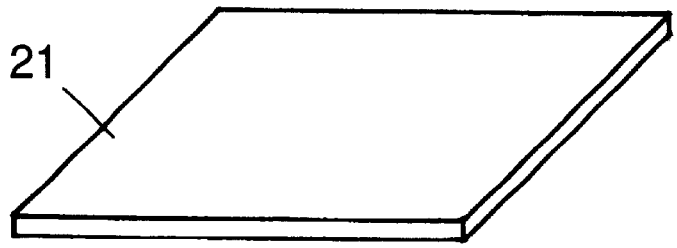
FIGS. 2(*a*) through 2(*d*) are procedural drawings showing a method of manufacturing the chip PTC thermistor in the first exemplary embodiment of the present invention.
Figure 2B:
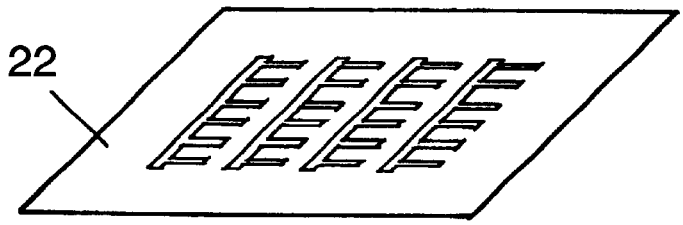
Figure 2C:
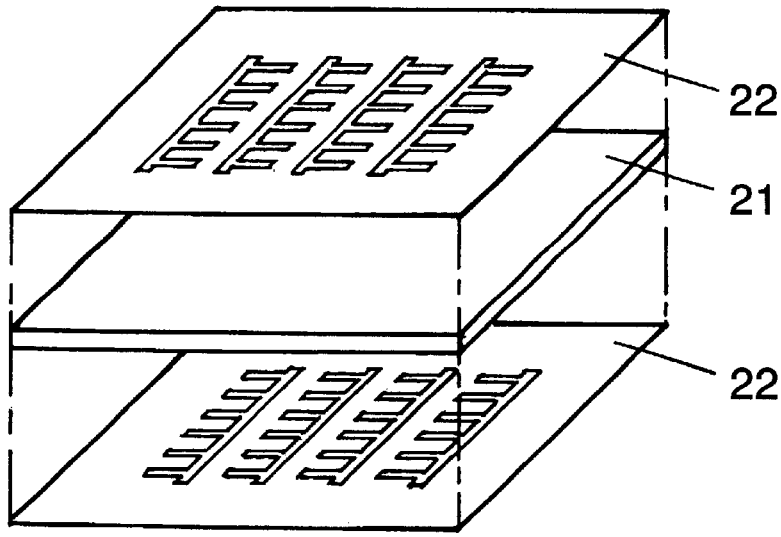
Figure 2D:
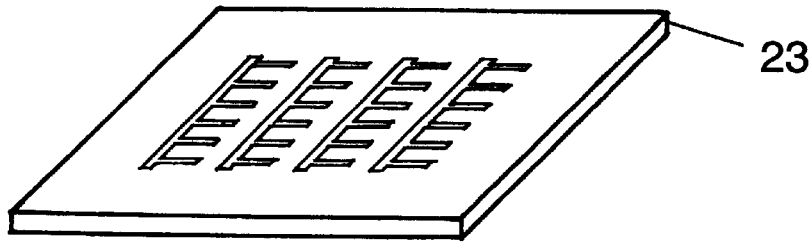
Figure 3A:
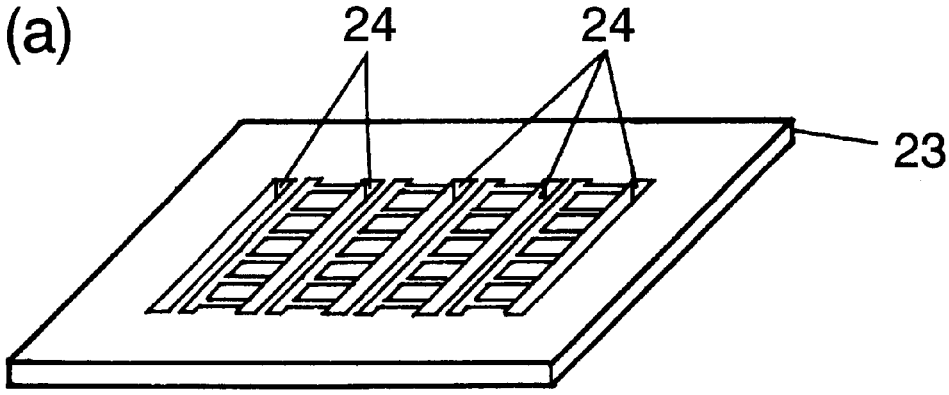
FIGS. 3(*a*) through 3(*d*) are perspective views showing the method of manufacturing the chip PTC thermistor in the first exemplary embodiment of the present invention.
Figure 3B:
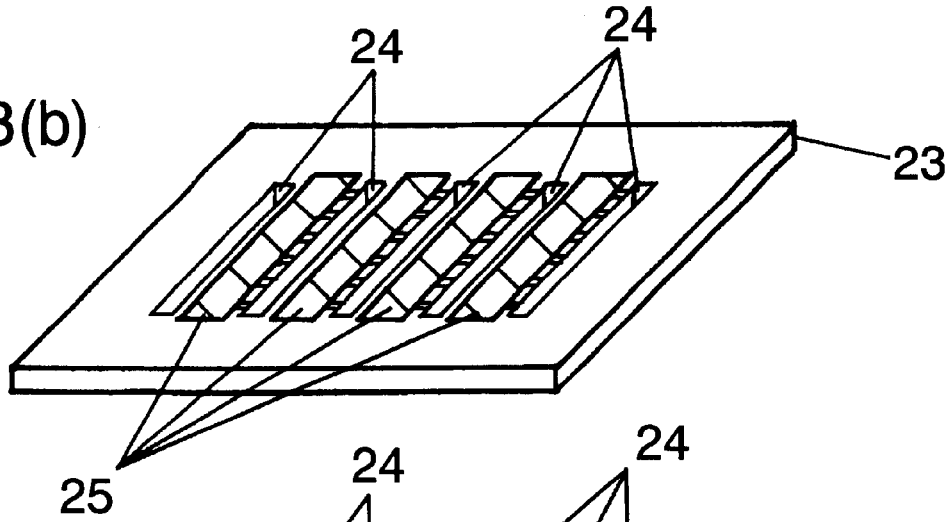
Figure 3C:
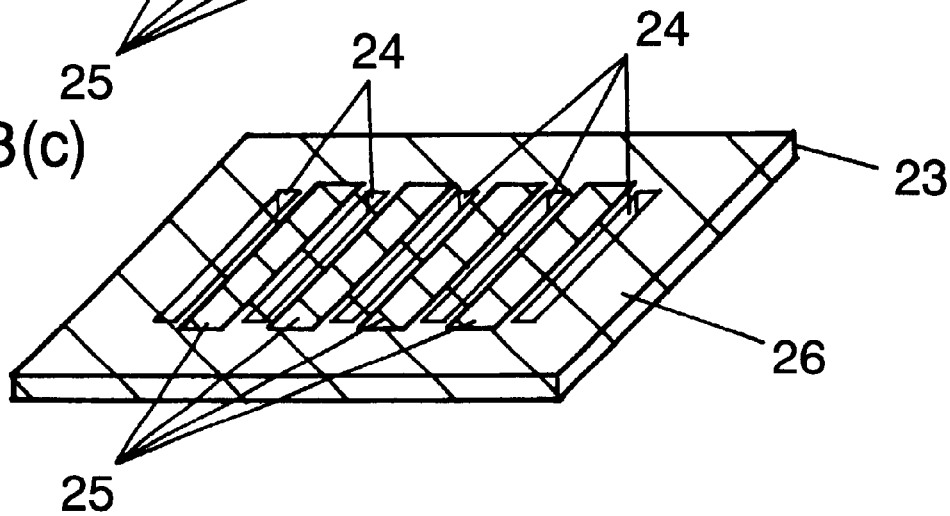
Figure 3D:
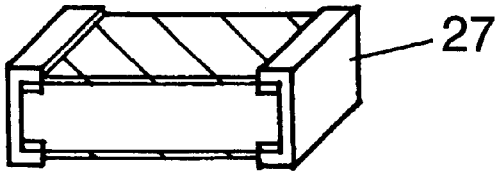

FIG. 1(*a*) is a perspective view of the chip PTC thermistor, and FIG. 1(*b*) is a sectional view taken along a line A–A' in FIG. 1(*a*), in the first exemplary embodiment of this invention.

In FIGS. 1(*a*) and 1(*b*), a reference numeral 11 represents an electrically conductive polymer (melting point: approx. 135° C.) in a cuboidal shape having a PTC characteristic, comprising a compound of high density polyethylene (melting point: approx. 135° C.), i.e. crystalline polymer, and carbon black, i.e. electrically conductive particles. A reference numeral 12*a* represents a first main electrode located on a first surface of the electrically conductive polymer 11. A reference numeral 12*b* represents a first sub-electrode located on the same surface as the first main electrode 12*a*, but independently from the first main electrode 12*a*. A reference numeral 12*c* is a second main electrode located on a second surface opposite to the first surface of the electrically conductive polymer 11, and a reference numeral 12*d* is a second sub-electrode located on the same surface as the second main electrode 12*c*, but independently from the second main electrode 12*c*. Each of the electrodes consists of a metallic foil such as electrolytic copper foil.

A first side electrode 13*a* consisting of a layer of electrolytically plated nickel, is disposed in such a manner as to surround over an entire side surface of the electrically conductive polymer 11, an edge portion of the first main electrode 12*a* and the second sub-electrode 12*d*, and to electrically connect the first main electrode 12*a* and the second sub-electrode 12*d*.

A second side electrode 13*b* consisting of a layer of electrolytically plated nickel, is also disposed in such a manner as to surround over an entire surface of another side opposite to the first side electrode 13*a* of the electrically conductive polymer 11, an edge portion of the second main electrode 12*c* and the first sub-electrode 12*b*, and to electrically connect the second main electrode 12*c* and the first sub-electrode 12*b*.

Reference numerals 14*a* and 14*b* are a first protective coating and a second protective coating respectively in green color, both serving also as plating resist, composed of polyester-based resin provided on outermost layers of the first surface and the second surface of the electrically conductive polymer 11. Incidentally, the first side electrode 13*a* and the second side electrode 13*b* may take any forms that can be provided on portions of the side surfaces of the PTC thermistor, or on the inside of the through-holes of the prior art structure.

A method of the first exemplary embodiment of this invention for manufacturing the chip PTC thermistor will now be described by referring to the accompanying figures.

FIGS. 2(*a*) through 2(*d*) and FIGS. 3(*a*) through 3(*d*) are showing the method of manufacturing the chip PTC thermistor in the first exemplary embodiment of this invention.

First, a 42 weight % of high density polyethylene (melting point: approx. 135° C.) having a crystallinity of 70 to 90%, a 57 weight % carbon black having a mean particle diameter of 58 nm and a specific surface area of 38 $m^2/g$, manufactured by furnace method, and a 1 weight % of antioxidant were kneaded for about 20 minutes with two-roll mill heated to approximately 170° C. The kneaded substance in a sheet-form was taken out from the two-roll mill, and an electrically conductive polymer 21 (melting point: approx. 135° C.) shown in FIG. 2(*a*), in a sheet-form having a thickness of approximately 0.16 mm was produced.

Next, a metallic foil 22 shown in FIG. 2(*b*) was made from electrolytic copper foil of approx. 80 μm by pattern forming with a press forming.

Next, a sheet 23 integrated as shown in FIG. 2(*d*) was produced by overlaying one each of the metallic foil 22 on top and bottom of the sheet-formed electrically conductive polymer 21, as shown in FIG. 2(*c*), and subjecting them to a compression molding for approx. 1 minute under a condition of 140° C. to 150° C. in temperature, approx. 20 torr in degree of vacuum, and approx. 50 $kg/cm^2$ in surface pressure.

After the integrated sheet 23 was thermally treated (approx. 20 minutes at 100° C. to 115° C.), it was irradiated with approx. 40 Mrad of electron beam in an electron beam irradiating apparatus to complete cress-linking of the high density polyethylene.

Long slit openings 24 were then formed at regular intervals in the integrated sheet 23, as shown in FIG. 3(*a*), by using a dicing machine, a milling machine, or the like, while cooling it with water. In the process of forming the openings 24, certain desired portions were left uncut in a longitudinal direction of the openings 24. In a process of rinsing and drying after the openings 24 were cut, the work was carried out at such a temperature that a temperature of the electrically conductive polymer 21 does not rise beyond the melting point (135° C.) of the electrically conductive polymer 21.

Next, an upper surface and a lower surface of the sheet 23 provided with the openings 24 was screen-printed with green colored paste of polyester based thermo-setting resin, except for an area surrounding the opening 24, as shown in FIG. 3(*b*), and a protective coating 25 also serving as plating resist was formed by curing it (at 125° C. to 130° C. for approx. 10 minutes) in a curing oven.

Then, a side electrode 26 was formed, as shown in FIG. 3(*c*), on a portion of the integrated sheet 23, where the protective coating 25 also serving as plating resist is not formed, and on inner surfaces of the openings 24. The side electrode 26 was formed by electrolytic nickel plating in a thickness of approx. 15 μm in a sulfamic acid nickel bath under a condition of an electric current density of 4 $A/dm^2$, for about 30 minutes The sheet 23 of FIG. 3(*c*) was divided, thereafter, into individual pieces with a dicing machine to complete a chip PTC thermistor 27 shown in FIG. 3(*d*).

Hereinafter an advantage of the foregoing processes will be explained, wherein a temperature of the electrically conductive polymer 21 is so maintained as not to exceed the melting point (135° C. of the electrically conductive polymer 21 during the preparatory processes which include the steps from the forming of the openings 24 shown in FIG. 3(*a*) to the forming of the side electrode 26 shown in FIG. 3(*c*), by adopting the protective coating, also serving as plating resist, capable of being formed at a temperature equal to or lower than the melting point 135° C. of the electrically conductive polymer.

In comparison, a protective coating 25, also serving as plating resist, was formed by screen-printing a resin paste of the ordinary epoxy based thermo-setting resin and curing it (at 140° C. to 150° C. for approx. 10 minutes) in an oven, in the step of forming the protective coating 25, also serving as plating resist, shown in FIG. 3(*b*). The following problem arose in this case, in the step of forming the side electrode 26.

Figure 4:
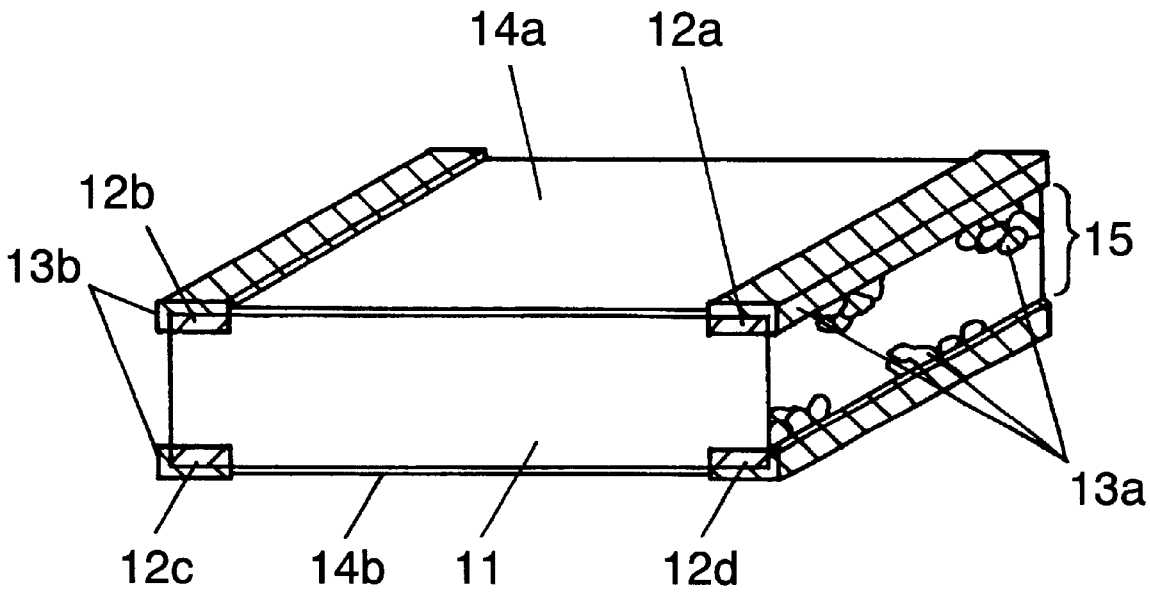
FIG. 4 is a perspective view of a chip PTC illustrating an example of a defectively formed electrode.
Figure 5A:
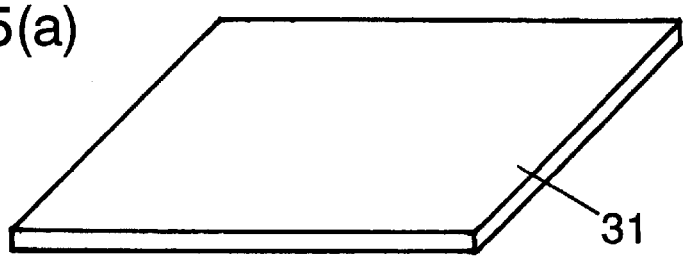
FIGS. 5(*a*) through 5(*e*), are perspective views showing a method of manufacturing a chip PTC thermistor in a second exemplary embodiment of the present invention.
Figure 5B:
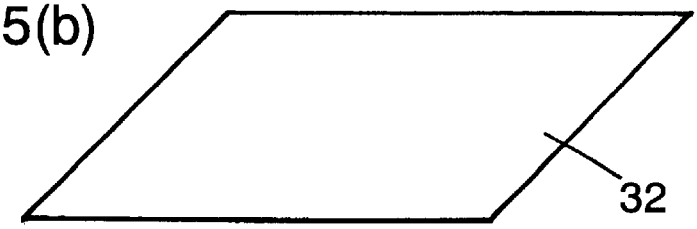
Figure 5C:
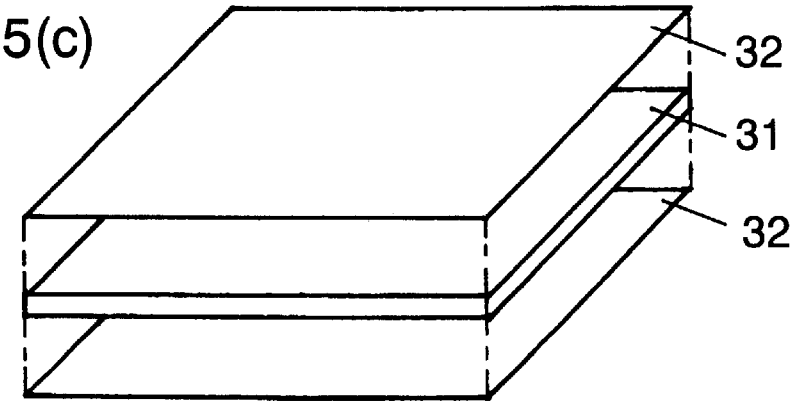
Figure 5D:
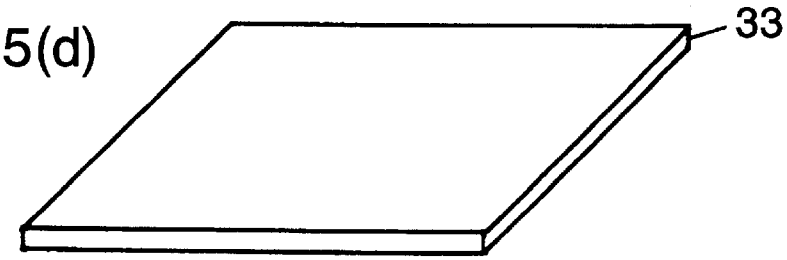
Figure 5E:
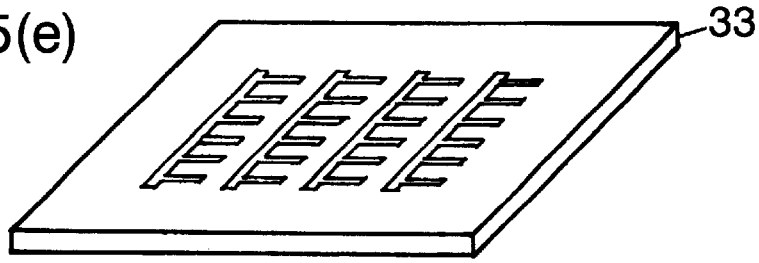
Figure 6A:
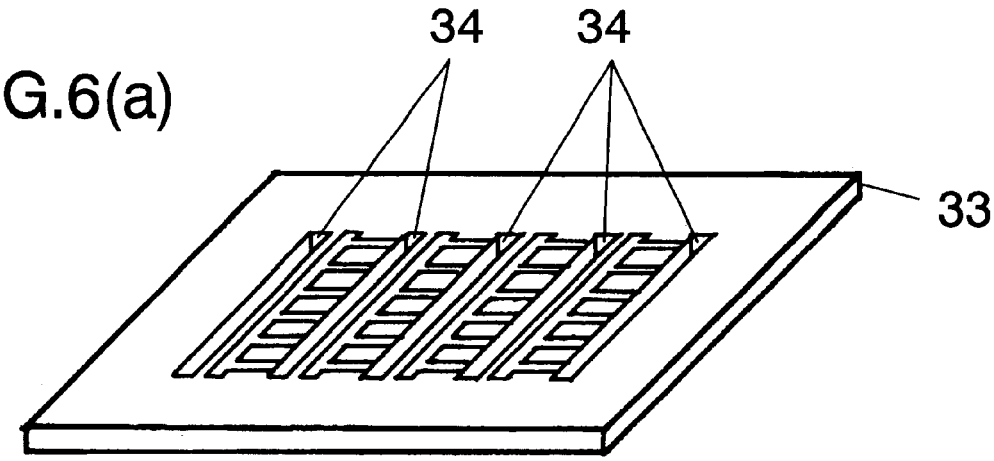
FIGS. 6(*a*) through 6(*d*) are perspective views showing the method of manufacturing the chip PTC thermistor in the second exemplary embodiment of the present invention.
Figure 6B:
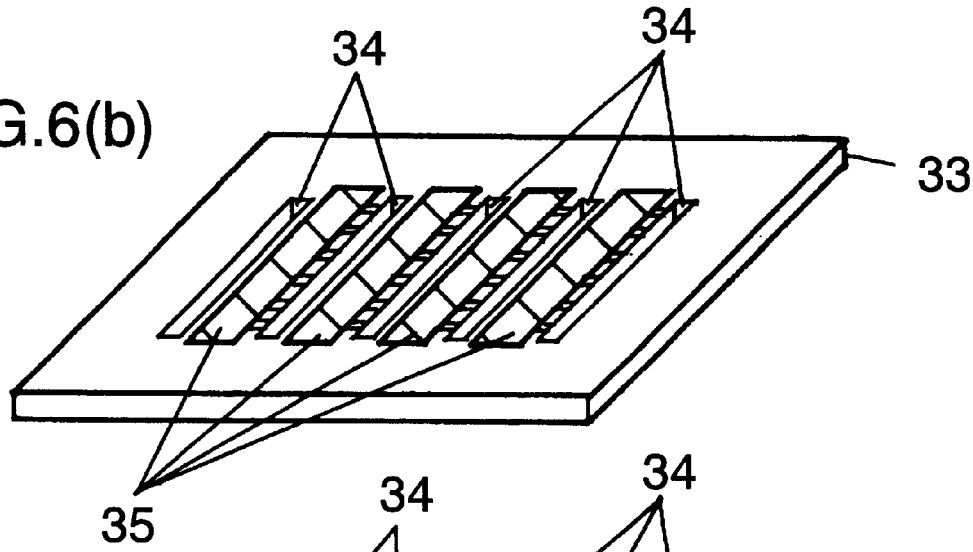
Figure 6C:
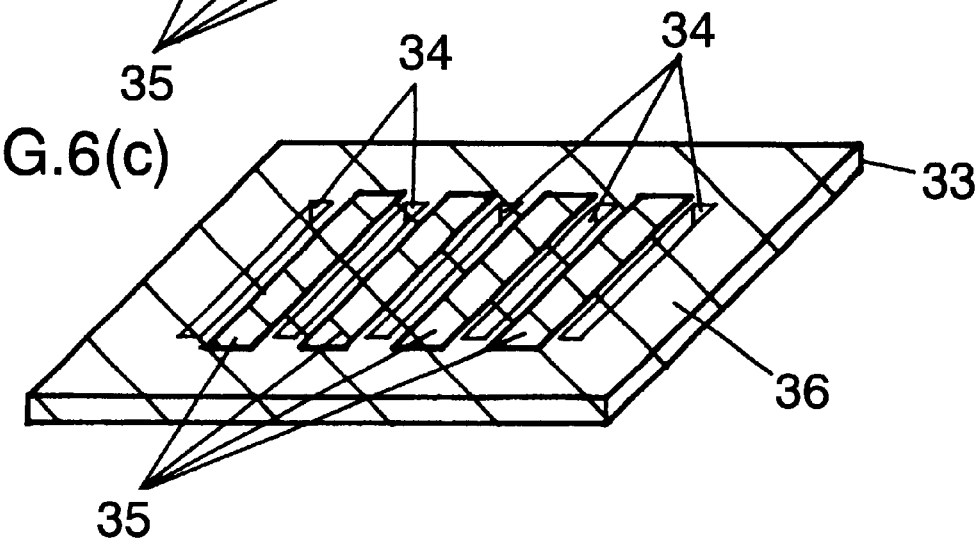
Figure 6D:
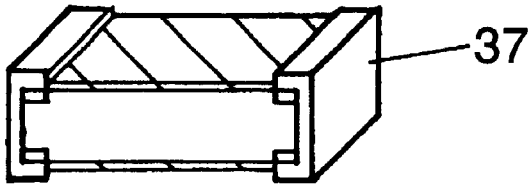

First of all, FIG. 4 shows an example of defects developed when the side electrodes 13*a* and 13*b* of the chip PTC thermistor were formed.

In FIG. 4, a reference numeral 15 represents a defective portion formed in the side electrodes 13*a* and 13*b*. Although nickel plating is properly formed on the main electrodes 12*a*, 12*c*, and the sub-electrodes 12*b* and 12*d*, the same nickel plating is formed only partially on the electrically conductive polymer 11. Therefore, the main electrodes 12*a* and 12*c*, and the sub-electrodes 12*b* and 12*d* have not connected both electrically and physically. This is caused by the fact that the electrically conductive polymer 11 is unable to keep an electrical conductivity in its surface, while the main electrodes 12*a* and 12*c* as well as the sub-electrodes 12*b* and 12*d*, being metal parts, keep high electrical conductivity. It is presumed that the surface of the electrically conductive polymer 11 is unable to maintain the electrical conductivity, because the electrically conductive polymer 11 is heated beyond the melting point of 135° C. under the processing temperature of 140° C. to 150° C. for 10 minutes, which causes the polyethylene element within the electrically conductive polymer 11 to migrate toward its surface. Naturally, a film of the electrolytic plating is not formed on the portion where electrical conductivity is lost, thereby giving rise to defective formation of the side electrodes 13*a* and 13*b*.

There are two important points described below in order to avoid the foregoing problem, and to ensure reliability of connection by successfully forming the side electrode 26.

The first one is to use a protective coating 25 serving as plating resist that can be formed at a temperature equal to or less than the melting point of 135° C. of the electrically conductive polymer 21.

The second one is to prevent temperature of the electrically conductive polymer 21 being heated up to the melting point (135° C.) or higher during the steps from the forming of the openings 24 through the completing the formation of the side electrode 26.

It is therefore necessary to prevent the temperature of the electrically conductive polymer 21 from being heated to the melting point (135° C.) or higher even with a processing temperature in any step other than the step of forming the protective coating 25, also serving as plating resist, such as a processing temperature when rinsing and drying it, and so on, after the dicing, for the same reason as described above.

Because of the above reason, the first exemplary embodiment of this invention does not cause a crack in the side electrode 26 composed of a layer of electrolytically plated nickel, even if the protective coating 25, also serving as plating resist, is formed upon consideration of a short circuiting due to deviation in a position of soldering on a printed circuit board.

This exemplary embodiment can also provide the chip PTC thermistor having superior reliability of connection, as it does not cause such a problem as not forming the side electrode 26 uniformly on the inner surface of the opening 24.

An advantage of the first exemplary embodiment of this invention for forming the side electrode 26 with the layer of electrolytically plated nickel will be described hereinafter.

First of all, it requires approx. 30 minutes with an electric current density of about 4.0 A/dm$^2$ in order to form the side electrode 26 in a thickness of 15 $\mu$m in the case of electrolytic nickel plating in the step of forming the side electrode. On the contrary, it requires more than twice as long to approx. 80 minutes with an electric current density of approx. 1.5 A/dm$^2$ in the case of electrolytic copper plating. Defects such as yellowing, abnormal deposition, and the like of the plating occur if the electric current density for the electrolytic copper plating is increased to about 4.0 A/dm$^2$ for the purpose of forming the plated film within a short period of time. In the case of the electrolytic copper plating, therefore, it is difficult to form a plated film of the same thickness as the electrolytic nickel plating in a short period of time.

In addition, a thermal-shock test (between −40° C. for 30 minutes and +125° C. for 30 minutes) was performed on samples having a side electrode of the same. thickness prepared with a layer of the electrolytically plated nickel, and a layer of the electrolytically plated copper. No defect such as a crack, etc. occurred on any of the electrode samples formed with the layer of electrolytically plated nickel, upon observation of polished sections after completion of a 100-cycle and a 250-cycle thermal shock tests. In the case of the samples formed with the layer of electrolytically plated copper, however, a crack occurred, as was observed on polished sections after a completion of the 100-cycle thermal shock test. Moreover, it was observed that some of the samples show a complete disconnection due to cracks after the 250-cycle thermal shock test.

The above results suffice it to note that the side electrode 26 formed with the layer of electrolytically plated nickel has such effects as shortening a manufacturing time and improving the reliability of connection.

SECOND EXEMPLARY EMBODIMENT

A method of manufacturing a chip PTC thermistor in a second exemplary embodiment of the present invention will be described next by referring to FIGS. 5 and 6.

FIGS. 5(*a*) through 5(*e*) and FIGS. 6(*a*) through 6(*d*) show the method of manufacturing the chip PTC thermistor in the second exemplary embodiment of this invention.

An electrically conductive polymer 31 (melting point: approx. 135° C.) shown in FIG. 5(*a*), in a sheet-form having a thickness of approximately 0.16 mm was produced in the same manner as in the first exemplary embodiment.

Next, an integrated sheet 33 shown in FIG. 5(*d*) was produced by overlaying a metallic foil 32 shown in FIG. 5(*b*) composed of an electrolytic copper foil of approx. 80 $\mu$m on top and bottom of the electrically conductive polymer 31, as shown in FIG. 5(*c*), and subjecting them to a thermal-compression molding for approx. 1 minute at 140° C. to 150° C. in temperature, approx. 40 torr in degree of vacuum, and approx. 50 kg/cm$^2$ in surface, pressure.

The metallic foils 32 on the top and the bottom surfaces of the integrated sheet 33 were etched by the photolithographic process to form a pattern as shown in FIG. 5(*e*).

The sheet 33, formed with the pattern, was thermally treated (at 100° C. to 115° C. for approx. 20 minutes), and it was irradiated with approx. 40 Mrad of electron beam in an electron beam irradiating apparatus to complete cresslinking of the high density polyethylene. A chip PTC thermistor 37 shown in FIG. 6(*d*) was obtained by taking manufacturing steps thereafter, as shown in FIGS. 6(*a*) through 6(*d*), in the same manner as the first exemplary embodiment of this invention.

The chip PTC thermistor 37 manufactured in the manner as described above has similar effects as those of the first exemplary embodiment of this invention. That is, this exemplary embodiment can provide for the chip PTC thermistor having superior reliability of connection, as it does not cause such a problem as having a crack in a side electrode 36 composed of a layer of electrolytically plated nickel, and a defect in formation oft he side electrode 36, even if a protective coating 35, also serving as plating resist, is formed upon consideration of a short circuiting due to deviation in a position of soldering on a printed wiring board.

THIRD EXEMPLARY EMBODIMENT

Figure 7A:
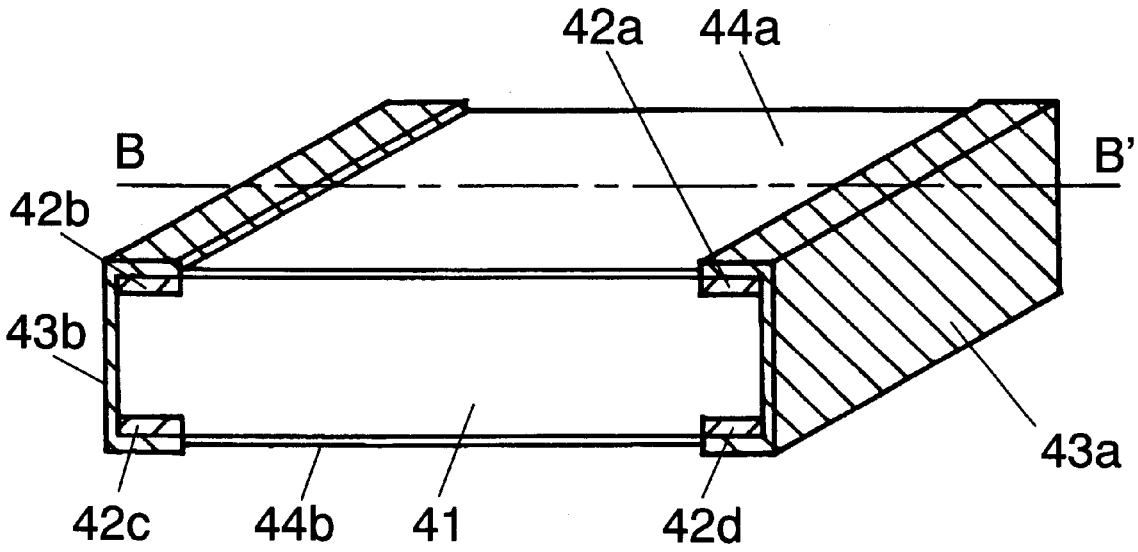
FIG. 7(*a*) is a perspective view of a chip PTC thermistor in a third exemplary embodiment of the present invention.
Figure 7B:
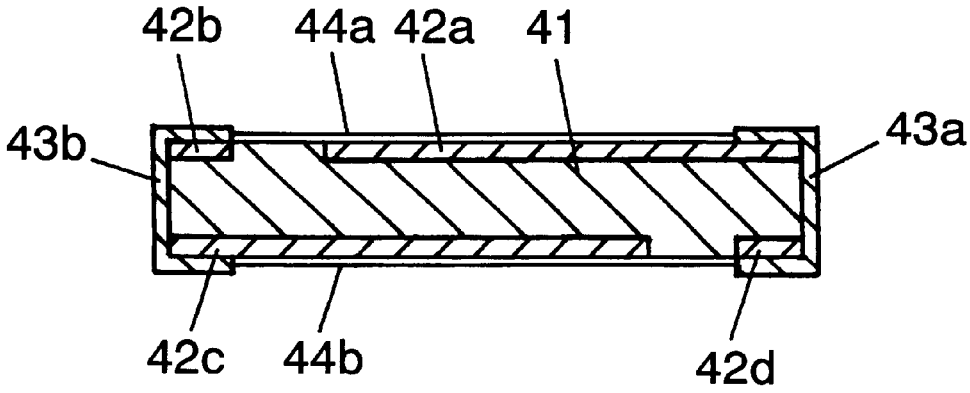
Figure 8A:
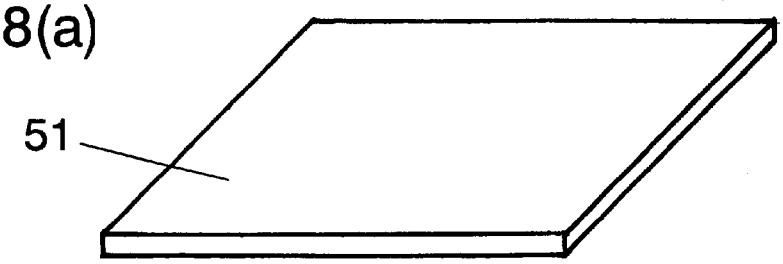
FIGS. 8(*a*) through 8(*d*) are perspective views showing a method of manufacturing a chip PTC thermister in the third exemplary embodiment of the present invention.
Figure 8B:
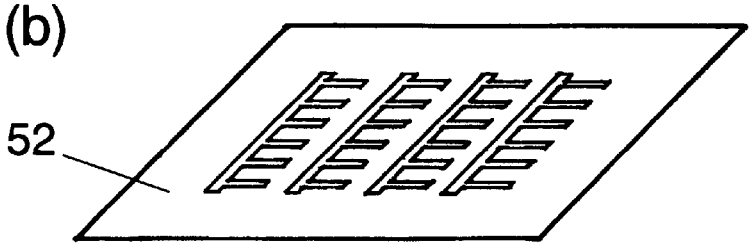
Figure 8C:
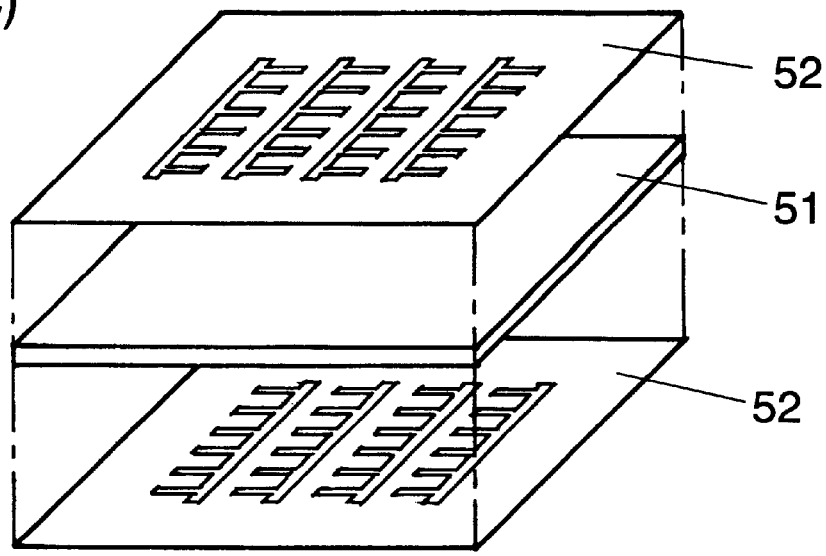
Figure 8D:
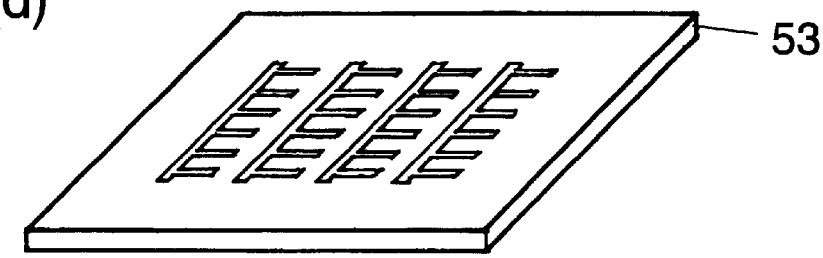
Figure 9A:
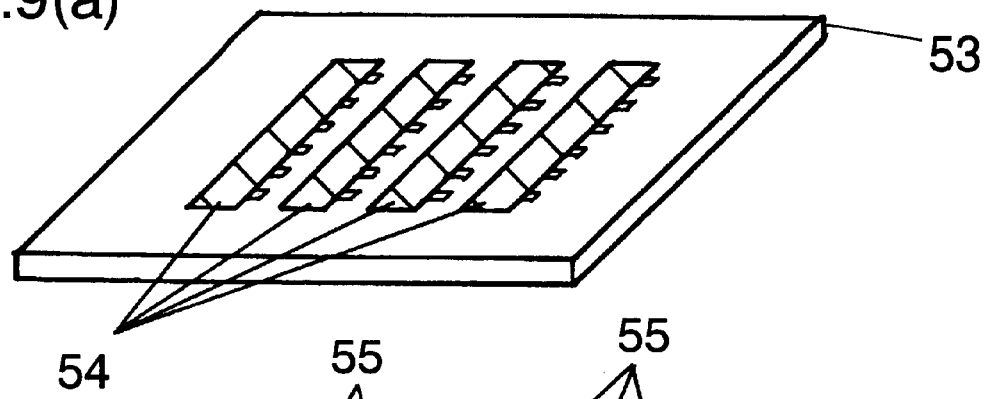
FIGS. 9(*a*) through 9(*d*) are perspective views showing the method of manufacturing the chip PTC thermistor in the third exemplary embodiment of the present invention.
Figure 9B:
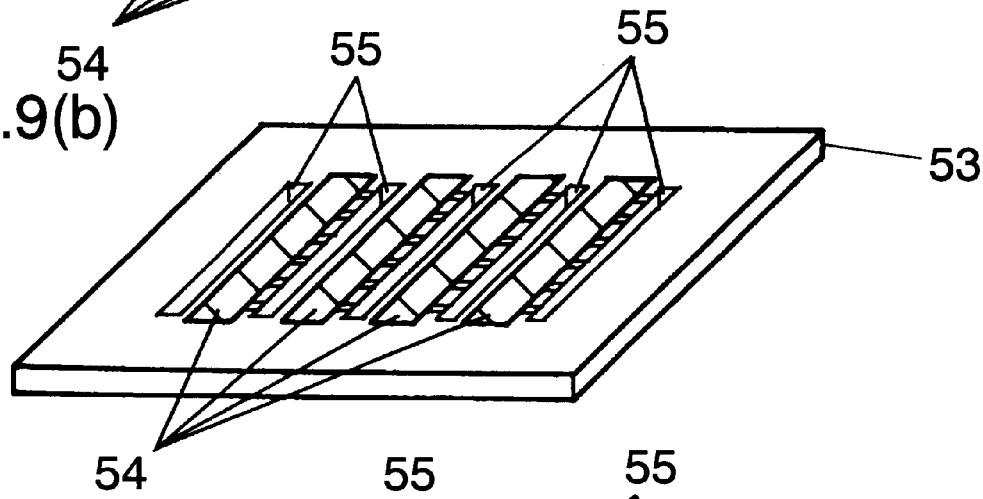
Figure 9C:
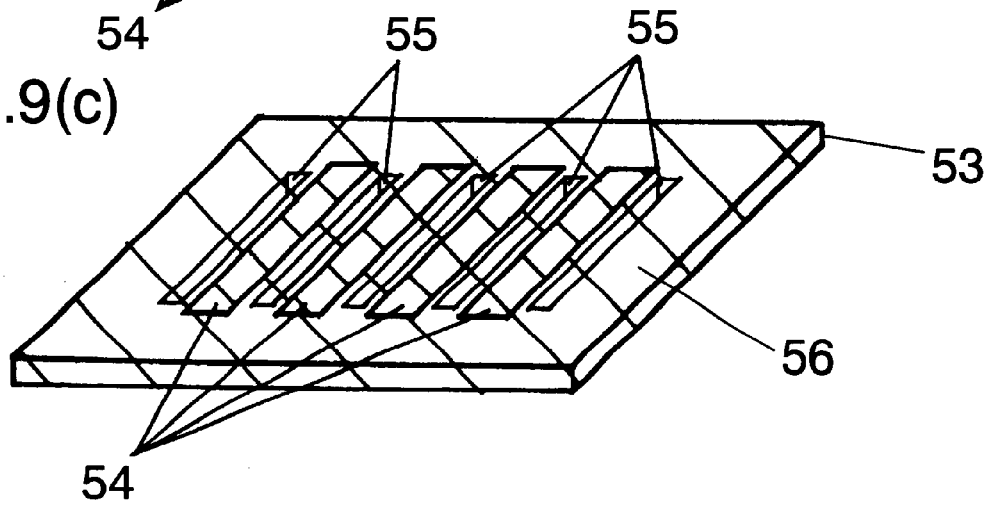
Figure 9D:
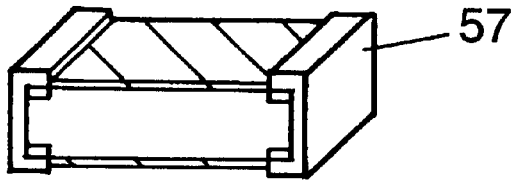
Figure 10A:
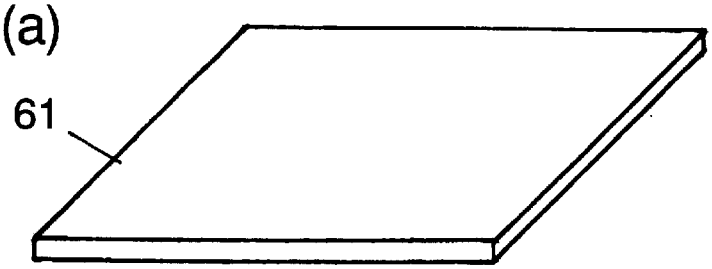
FIGS. 10(*a*) through 10(*e*) are perspective views showing a method of manufacturing a chip PTC thermistor in a fourth exemplary embodiment of the present invention.
Figure 10B:
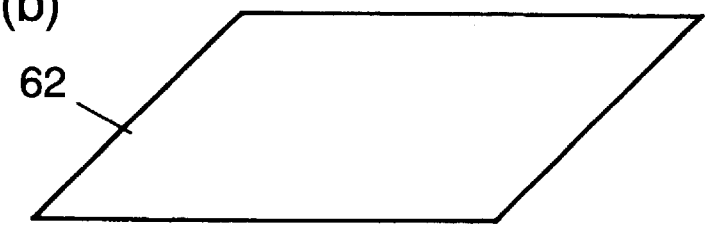
Figure 10C:
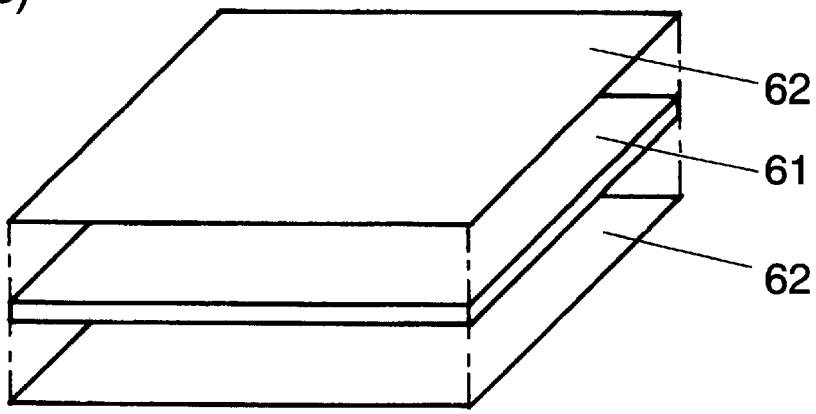
Figure 10D:
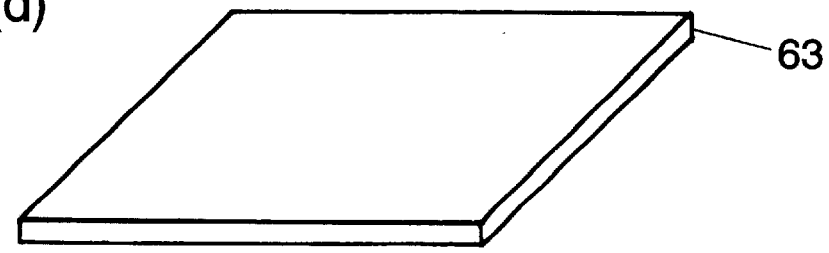
Figure 10E:
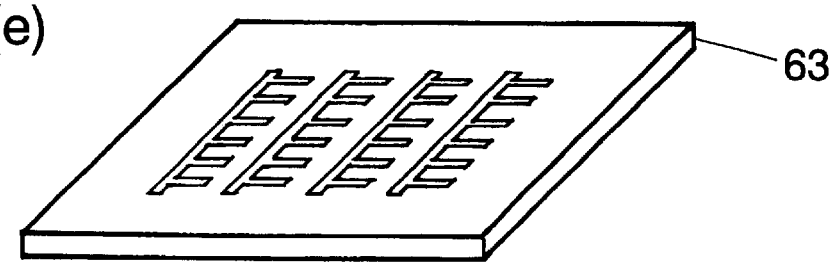
Figure 11A:
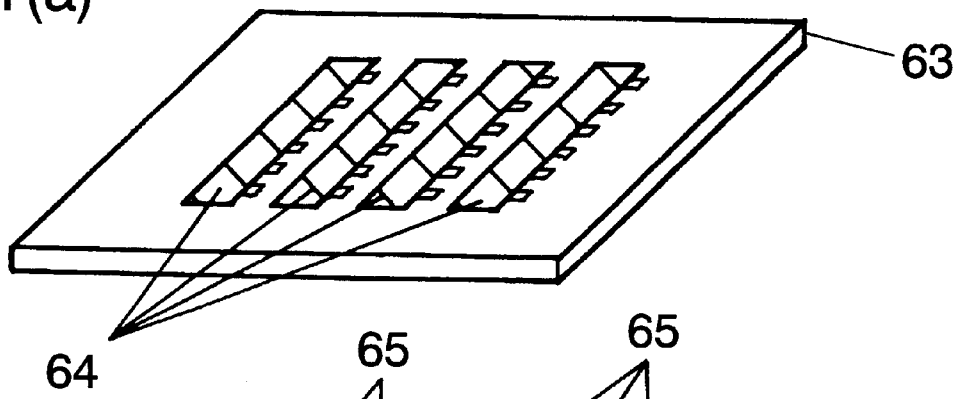
FIGS. 11(*a*) through 11(*d*) are perspective views showing the method of manufacturing the chip PTC thermistor in the fourth exemplary embodiment of the present invention.
Figure 11B:
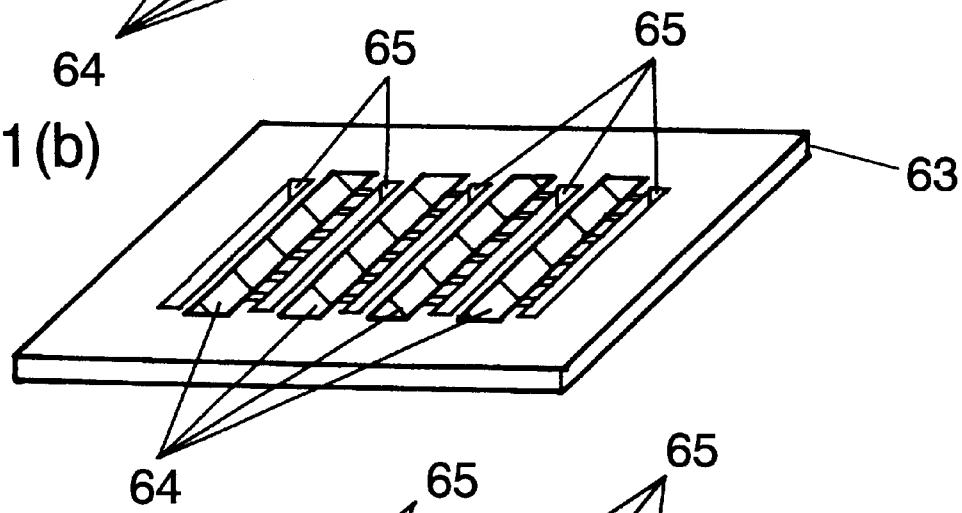
Figure 11C:
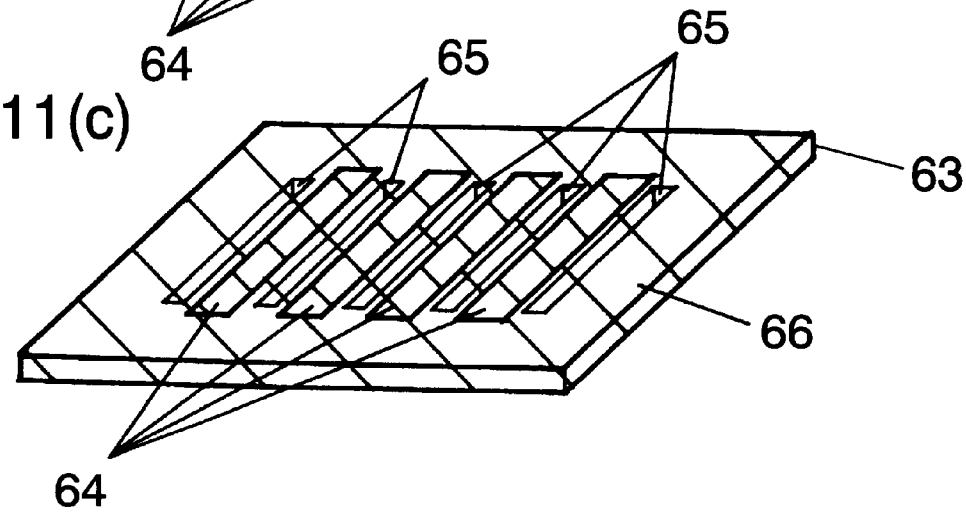
Figure 11D:
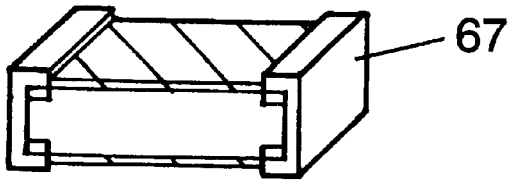
Figure 12A:
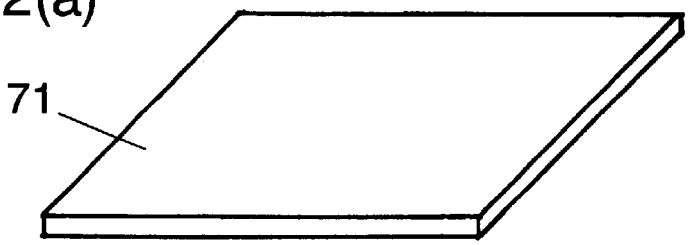
FIGS. 12(*a*) through 12(*d*) are perspective views showing a method of manufacturing a chip PTC thermistor in a fifth exemplary embodiment of the present invention.
Figure 12B:
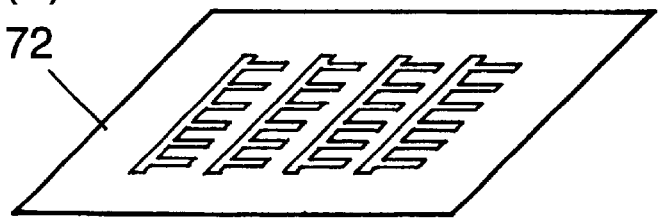
Figure 12C:
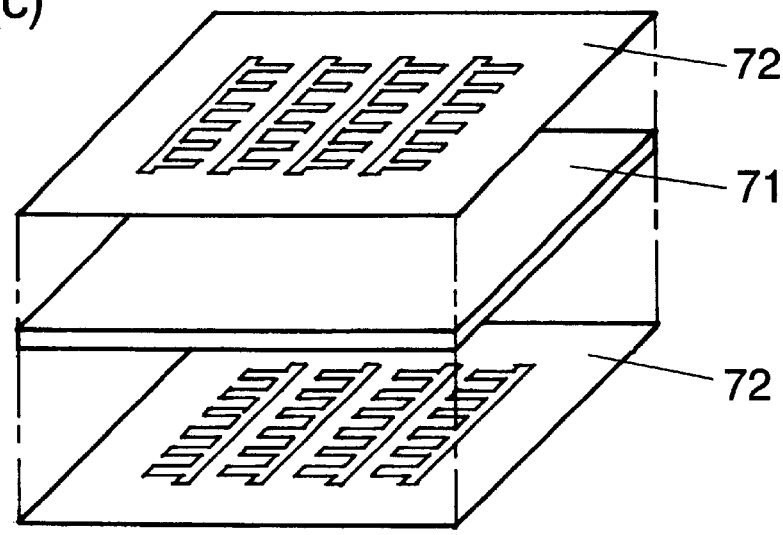
Figure 12D:
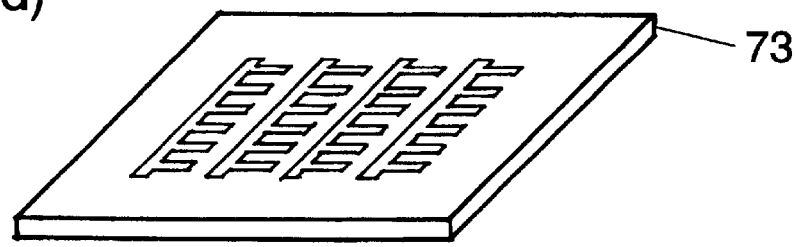
Figure 13A:
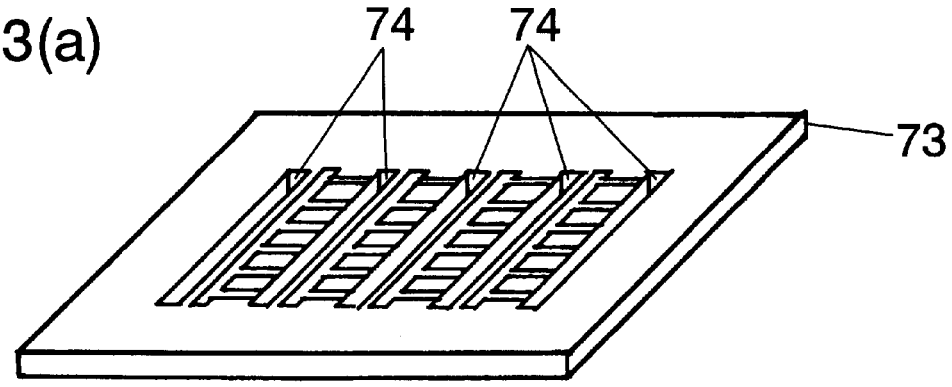
FIGS. 13(*a*) through 13(*d*) are also perspective views showing the method of manufacturing the chip PTC thermistor in the fifth exemplary embodiment of the present invention.
Figure 13B:
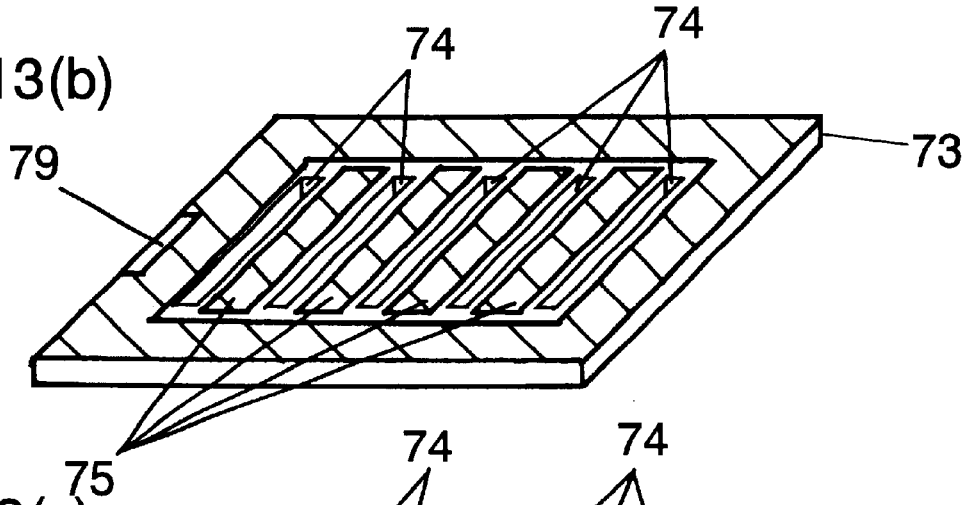
Figure 13C:
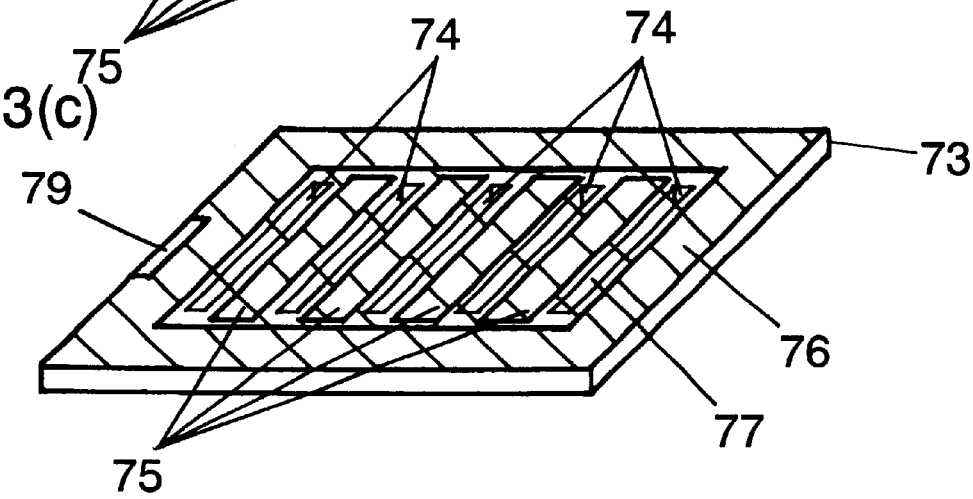
Figure 13D:
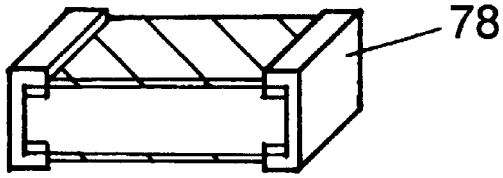

A chip PTC thermistor and a method of manufacturing the same in a third exemplary embodiment of this invention will be described next by referring to the accompanying figures. FIG. 7(*a*) is a perspective view of the chip PTC thermistor, and FIG. 7(*b*) is a sectional view taken along a line B–B' in FIG. 7(*a*), in the third exemplary embodiment of this invention.

A structure of the chip PTC thermistor shown in FIG. 7(*a*) and 7(*b*) is the same in principle with that of the first exemplary embodiment. This exemplary embodiment differs from the first exemplary embodiment, in that first and second protective coatings 44*a* and 44*b*, also serving as plating resist of green color, provided on outermost layers of a first surface and a second surface of an electrically conductive polymer 41 are composed of epoxy based resin.

The method of the third exemplary embodiment of this invention for manufacturing the chip PTC thermister will be described next by referring to FIGS. 8(*a*) through 8(*d*) and FIGS. 9(*a*) through 9(*d*).

Manufacturing processes of this exemplary embodiment are the same as those of the first exemplary embodiment, up to the step for irradiating the electron beam on an integrated sheet.

Next, an upper surface and a lower surface of an integrated composite sheet 53 was screen-printed with green colored paste of epoxy based thermo-setting resin, and a protective coating 54, also serving as plating resist, was formed by curing it (at 145° C. to 150° C. for approx. 10 minutes) in a curing oven, as shown in FIG. 9(*a*).

Long slit openings 55 were then formed at regular intervals in the integrated sheet 53, as shown in FIG. 9(*b*), by using a dicing machine, a milling machine, or the like, while cooling it with water. In the process of forming the openings 55, predetermined portions were left uncut in a longitudinal direction of the openings 55. In the case of rinsing and drying it after the openings 55 were cut, the work was carried out at such a temperature that a temperature of an electrically conductive polymer 51 does not rise beyond the melting point (135° C.) of the electrically conductive polymer 51.

Then, a side electrode 56 comprising a layer of electrolytically plated nickel in a thickness of approx. 15 $\mu$m was formed, as shown in FIG. 9(*c*), on a portion of the sheet 53, where the protective coating 54, also serving as plating resist, is not formed, and on inner walls of the openings 55 by nickel plating in a sulfamic acid nickel bath under a condition of an electric current density of 4 A/dm$^2$, for about 30 minutes.

The sheet 53 of FIG. 9(*c*) was divided, thereafter, into individual pieces with a dicing machine to complete a chip PTC thermister 57 shown in FIG. 9(*d*).

An effect of the manufacturing method shown in this third exemplary embodiment of the present invention will be described hereinafter.

First, there is a necessity, for the same reason as what has been described in the first exemplary embodiment of this invention, that temperature of the electrically conductive polymer 51 is maintained so as not to exceed the melting point (135° C.) of the electrically conductive polymer 51 during the preparatory processes from the step of forming the openings 55 shown in FIG. 9(*b*) to the step of forming a side electrode 56 shown in FIG. 9(*c*). The purpose of this is to properly form the side electrode 56 that is an essential point to assure reliability of connection.

Next, an advantage of forming the protective coating 54, also serving as plating resist, shown in FIG. 9(*a*), before cutting the openings 55 shown in FIG. 9(*b*), will be described.

It becomes unnecessary to restrict material used for forming the protective coating 54, also serving as plating resist, to such a material that can be formed at a temperature below the melting point (135° C.) of the electrically conductive polymer 51, when the protective coating 54 serving as plating resist is formed before cutting the openings 55. Therefore, this gives an advantage that material can be selected freely among a variety of general resin materials that can be formed at about 150° C., according to characteristics necessary with respect to adhesiveness, mechanical strength, and so on. Furthermore, it can give such an effect as to shorten a curing time and to improve adhesion by increasing a curing temperature to approx. 150° C. for a material that can be formed at the curing temperature of 130° C. or below.

FOURTH EXEMPLARY EMBODIMENT

A method of a fourth exemplary embodiment of this invention for manufacturing a chip PTC thermistor will be described next by referring to FIGS. 10(*a*) through 10(*e*) and FIGS. 11(*a*) through 11(d). Manufacturing processes of this exemplary embodiment are the same as those of the second exemplary embodiment, up to the step for irradiating electron beam on an integrated sheet.

A chip PTC thermistor 67 shown in FIG. 11(*d*) was obtained by taking the manufacturing steps shown in FIG. 11(*a*) through 11(*d*) in the same manner as those of the third exemplary embodiment of this invention.

The chip PTC thermistor 67 manufactured in the manner as described above has similar effects as those of the third exemplary embodiment of this invention. That is, this exemplary embodiment can provide a chip PTC thermistor having superior reliability of connection, as it does not cause such a problem as having a crack in a side electrode 66 composed of a layer of electrolytically plated nickel, and a defective formation of the side electrode, in that the side electrode 36 can not be formed uniformly over an inner surface of openings 65, even if a protective coating, also serving as plating resist, is formed upon consideration of a short circuiting, etc. due to deviation in a position of soldering on a printed wiring board.

In addition, it becomes unnecessary to restrict material used for forming the protective coating 64, also serving as plating resist, to such a material that can be formed at a temperature below the melting point (135° C.) of an electrically conductive polymer 51, when the protective coating 64 also serving as plating resist is formed before cutting the openings 65. Therefore, this gives an advantage that material can be selected freely among a variety of general resin materials that can be formed at about 150° C., according to characteristics necessary with respect to adhesion, mechanical strength, and so on. Furthermore, it can give such an effect as to shorten a curing time and to improve adhesion by increasing a curing temperature to approx. 150° C. for a material that can be formed at the curing temperature of 130° C. or below.

FIFTH EXEMPLARY EMBODIMENT

A method of a fifth exemplary embodiment of this invention for manufacturing a chip PTC thermistor will be described next by referring to FIGS. 12(*a*) through 12(*d*) and FIGS. 13(*a*) through 13(*d*). Manufacturing processes of this exemplary embodiment are the same as those of the first exemplary embodiment, up to the step for forming an opening 74.

Next, a protective coating 75, also serving as plating resist, and another plating resist 76 for masking purposes were formed at the same time with the same material by screen-printing green colored paste of polyester base thermo-setting resin on an upper surface and a lower surface of a sheet 73 provided with the openings 74, and by curing it (at 125° C. to 130° C. for approx. 10 minutes) in a curing oven, as shown in FIG. 13(*b*).

During this process, the protective coating 75, also serving as plating resist, was formed on a product part except for an area surrounding the openings 74, and the plating resist 76 for masking was formed on an area not usable for the product part of the sheet 73 with a contact point 79 for plating left intact.

Then, a side electrode 77 was formed, as shown in FIG. 13(*c*), on a portion of the sheet 73, where the protective coating 75, also serving as plating resist, and the plating resist 76 for masking are not formed, and on inner walls of the openings 74 by plating with nickel in a thickness of approx. 15 $\mu$m. The nickel plating was made in a sulfamic acid nickel bath under a condition of an electric current density of 4 A/dm$^2$, for about 30 minutes.

The sheet 73 of FIG. 13(*c*) was divided, thereafter, into individual pieces with a dicing machine to complete a chip PTC thermistor 78 shown in FIG. 13(*d*).

Described hereinafter is an effect of the plating resist 76 for masking.

Figure 14A:
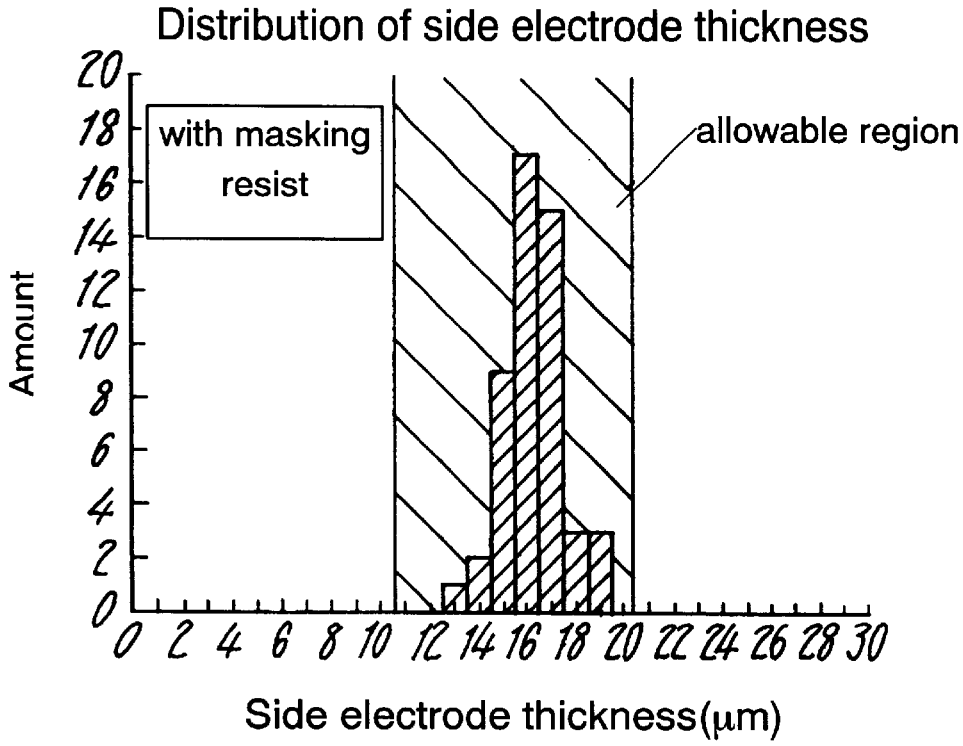
FIG. 14(*a*) is a graph showing a thickness of electrode in the case a plating resist for masking is provided.
Figure 14B:
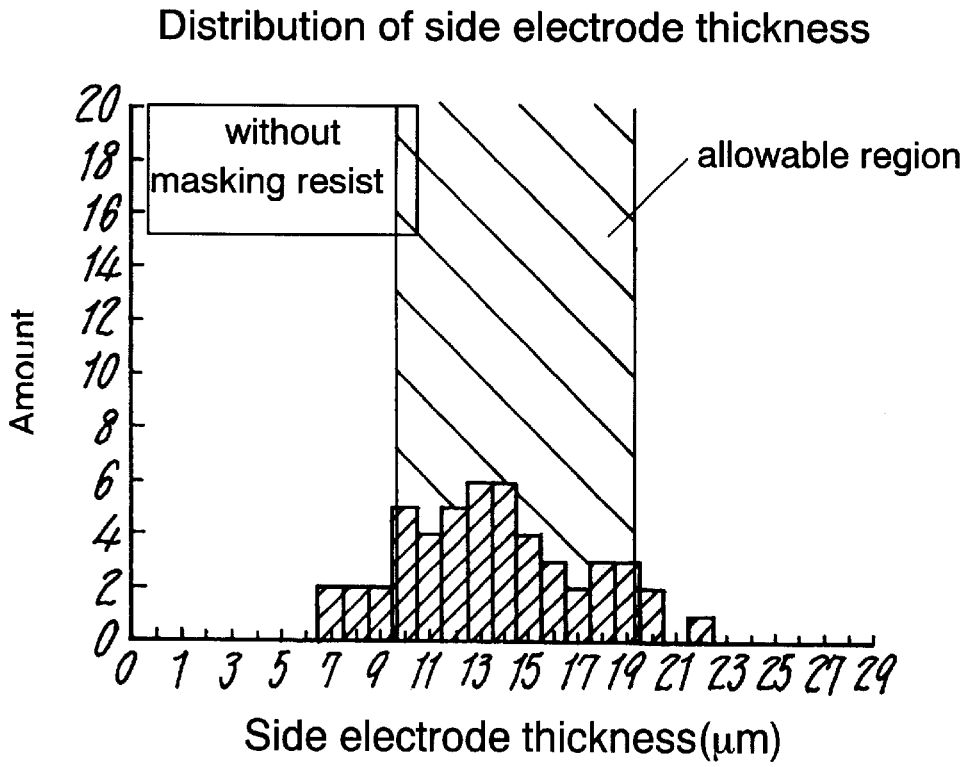
Figure 15A:
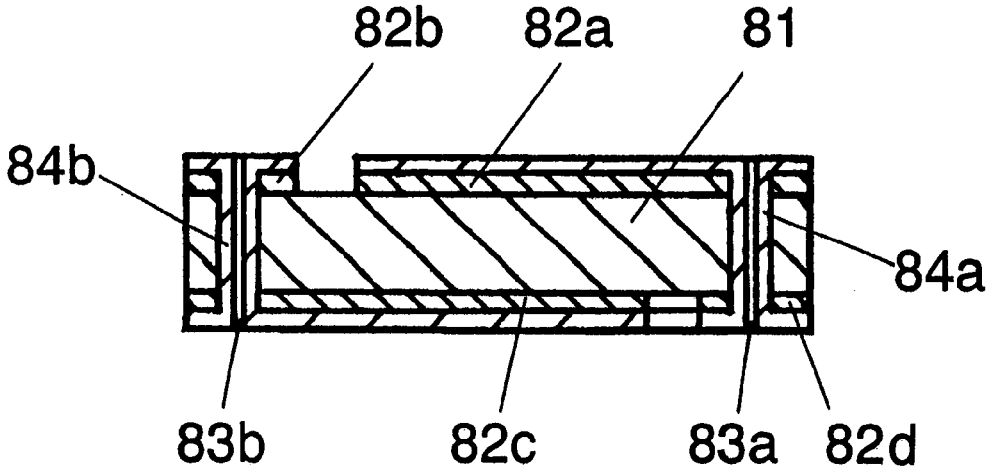
FIG. 15(a) Prior Art
FIG. 15(*a*) is a sectional view of a chip PTC thermistor of the prior art.
Figure 15B:
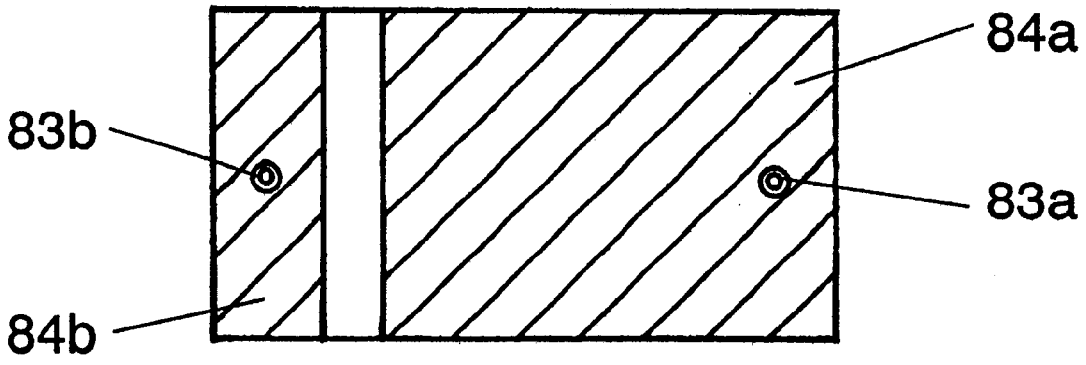
FIG. 15(b) Prior Art
Figure 16A:
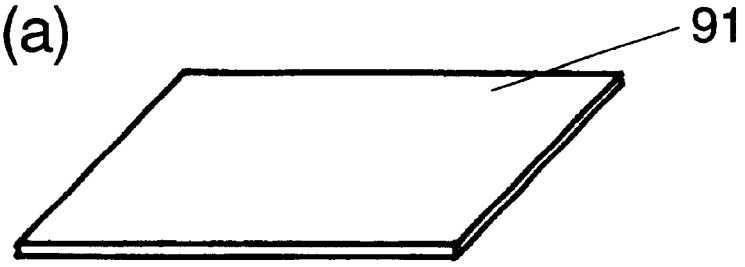
FIGS. 16(*a*) through 16(*d*) are perspective views showing a method of manufacturing the chip PTC thermistor of the prior art.
Figure 16B:
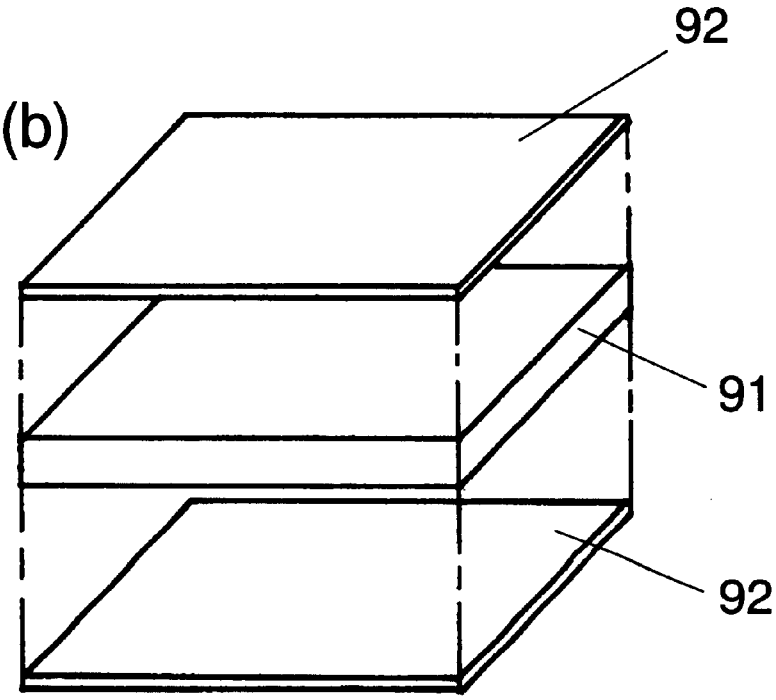
Figure 16C:
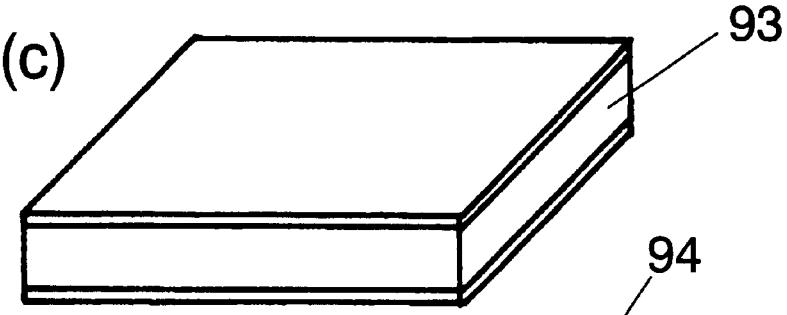
Figure 16D:
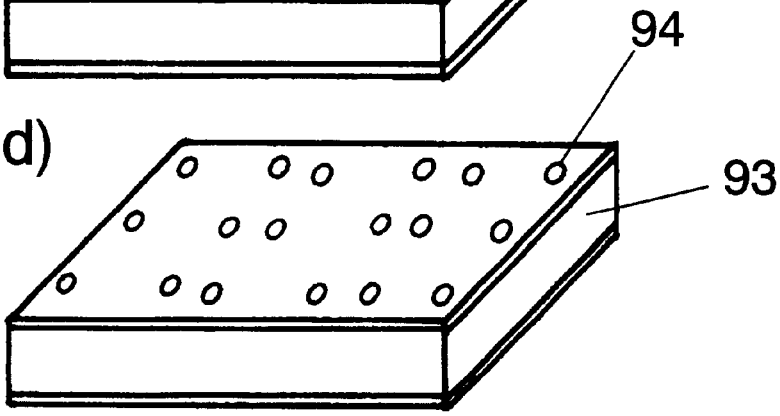
Figure 17A:
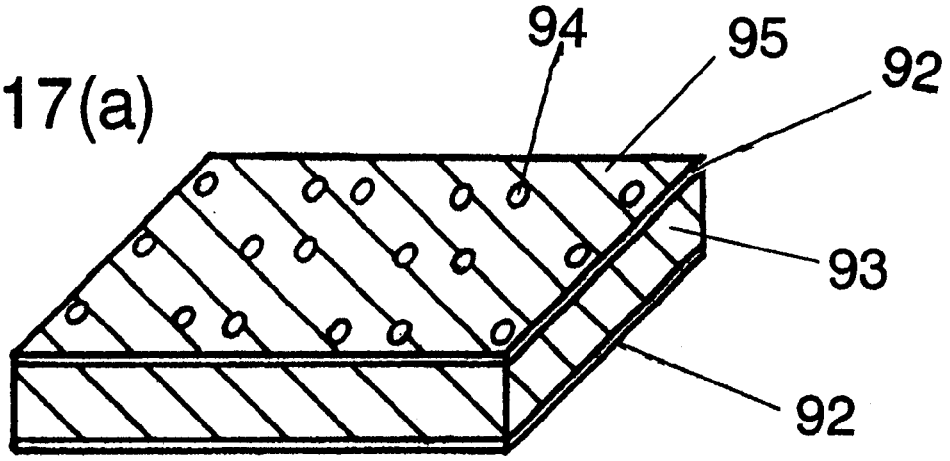
FIGS. 17(*a*) through 17(*c*) are perspective views showing a method of manufacturing a chip PTC thermistor of the prior art.
Figure 17B:
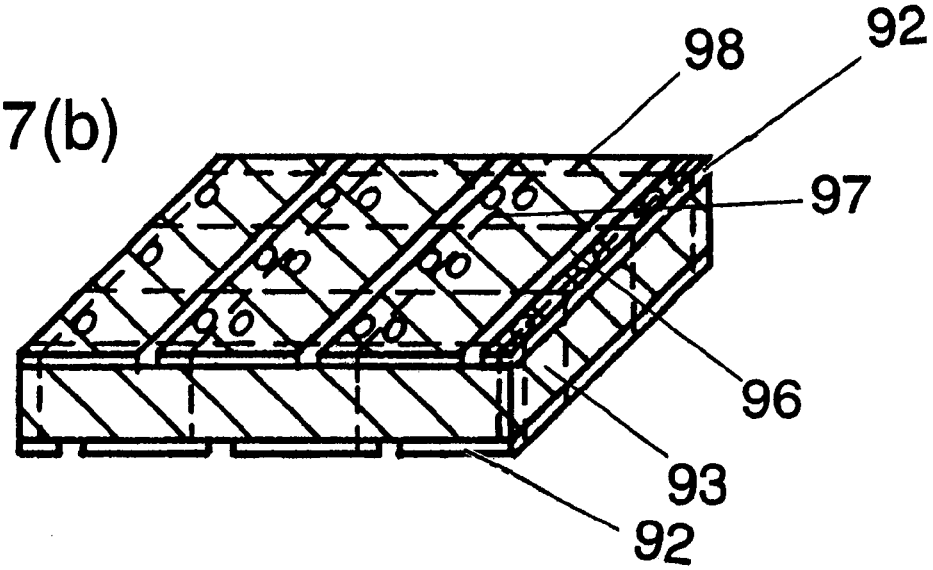
Figure 17C:
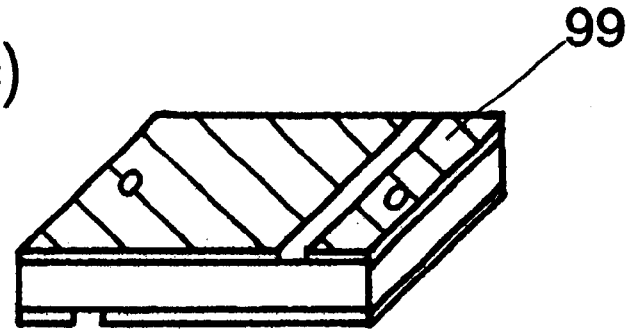

Two kinds of samples were prepared for comparison purposes, wherein the side electrode 77 was formed after forming the plating resist 76 for masking on the area not usable for the product part of the sheet 73, for one case, and the side electrode 77 was formed without forming the plating resist 76 for masking in another case. Fifty (50) samples were taken for each of the groups, and the thicknesses of the side electrodes 77 were measured by observing their sections. The results are shown in FIGS. 14(*a*) and 14(*b*). As it is obvious from FIGS. 14(*a*) and 14(*b*), the case where the plating resist 76 for masking was formed shows a smaller deviation in thickness of the side electrode 77. The reason of this is that a presence of the plating resist 76 for masking makes the electric current density uniform around an area of the side electrode 77 during the plating process.

Accordingly, the fifth exemplary embodiment for this invention can provide the chip PTC, thermistor exhibiting stable reliability of connection, since it can reduce the deviation in thickness of the side electrode 77, in addition to the effects provided by the first to the fourth exemplary embodiments.

The protective coating 75, also serving as plating resist, and the plating resist 76 for masking may be formed individually with different materials. However, a positional relation can be established firmly between the protective coating 75, also serving as plating resist, and the plating resist 76 for masking, if they are formed at the same time with the same material as in the case of this fifth exemplary embodiment of the invention. This method can therefore make the thickness of the side electrode more uniform as compared to the case in which they are formed individually. Moreover, it also provides an effect of a cost reduction by reducing the manufacturing steps, etc., since the protective coating 75 and the plating resist 76 for masking can be formed with a single step of printing.

Besides, although the polyester base thermo-setting resin was used for the protective coating 75 also serving as plating resist, and the plating resist 76 for masking, in the present exemplary embodiment, any other kind of epoxy based resin may also be used, as it is superior in its properties of heat resistance, chemical resistance, and adhesion, as described in the foregoing third and the fourth exemplary embodiments.

The manufacturing method does not cause a crack in the electrode due to an effect of heat during formation of the protective coating, serving also as plating resist, since the electrode is formed by plating only after the protective coating serving also as plating resist is formed.

Moreover, this method is able to form the electrode uniformly, since it maintains an electrical conductivity on a surface of the electrically conductive polymer, by way of controlling the processing temperature in such a manner as to prevent polymer in the electrically conductive polymer from migrating toward a surface of the electrically conductive polymer exposed on an inner surface of the opening. As a result, an effect capable of manufacturing the chip PTC thermistor having a superior reliability of connection can be obtained.

INDUSTRIAL APPLICABILITY

As has been described, a method of the present invention for manufacturing a chip PTC thermistor provides an effect of providing a manufacturing method of the chip PTC thermistor having superior reliability in connection, at low cost with excellent mass-productivity. Accordingly, the chip PTC thermistor can be used effectively as an over-current protective element in a variety of electronic devices.

What is claimed is:

1. A method of manufacturing a chip PTC thermistor comprising, in sequence:

forming a sheet by sandwiching an upper surface and a lower surface of an electrically conductive polymer having a PTC characteristic with metallic foils having a pattern formed thereon, and integrating said sheet by thermal-compression molding;

providing at least one opening in said integrated sheet;

forming a protective coating on respective first portions of an upper surface and a lower surface of said sheet provided with said opening, said protective coating also serving as a first plating resist, said protective coating formed at a temperature below a melting point of said electrically conductive polymer;

forming an electrode by electrolytic plating on said sheet having said protective coating formed thereon; and dividing said sheet having said electrode formed thereon into individual pieces, wherein said providing an opening, forming a protective coating, and forming an electrode, all conducted at a processing temperature not exceeding the melting point of said electrically conductive polymer.

2. The method of manufacturing a chip PTC thermister according to claim 1, wherein forming said electrode by electrolytic plating comprises electrolytic nickel plating.

3. The method of manufacturing a chip PTC thermistor according to claim 2, further comprising after forming said integrated sheet and before forming said electrode by electrolytic plating, forming a plating resist as a mask on respective second portions of the upper and the lower surfaces of said sheet, said respective second portions being other than a part of the chip PTC thermistor.

4. The method of manufacturing a chip PTC thermistor according to claim 3, wherein forming a second plating resist occurs at a time of forming a protective coating.

5. The method of manufacturing a chip PTC thermister according to claim 2, wherein the step of forming said sheet forming a sheet under a pressure lower than an atmospheric pressure.

6. The method of manufacturing a chip PTC thermister according to claim 5, wherein said pressure lower than the atmospheric pressure is at least 40 torr.

7. The method of manufacturing a chip PTC thermistor according to claim 1, further comprising after forming said integrated sheet and before forming said electrode by electrolytic plating, forming a second plating resist as a mask on respective second portions of the upper and the lower surfaces of said sheet, said respective second portions being other than a part of the chip PTC thermistor.

8. The method of manufacturing a chip PTC thermistor according to claim 7, wherein forming a second plating resist occurs at a time of forming a protective coating.

9. The method of manufacturing a chip PTC thermister according to claim 1, wherein forming a sheet comprises forming a sheet under a reduced pressure.

10. The method of manufacturing a chip PTC thermister according to claim 9, wherein said pressure is at least 40 torr.

11. A method of manufacturing a chip PTC thermistor comprising, in sequence:

forming a sheet by sandwiching an upper surface and a lower surface of an electrically conductive polymer having a PTC characteristic with metallic foils, and integrating them by thermal-compression molding;

forming a pattern by etching said metallic foils on an upper surface and a lower surface of said integrated sheet;

providing at least one opening in said sheet having the pattern formed thereon;

forming a protective coating, also serving as a plating resist, on the upper and the lower surfaces of said sheet provided with said opening, said protective coating formed at a temperature below a melting point of said electrically conductive polymer;

forming an electrode by electrolytic plating on said sheet having said protective coating, serving also as plating resist, formed thereon; and dividing said sheet having said electrode formed thereon into individual pieces, wherein said forming a pattern, providing an opening, forming a protective coating, and forming an electrode, all conducted at a processing temperature not exceeding the melting point of said electrically conductive polymer.

12. A method of manufacturing a chip PTC thermister comprising in sequence:

forming a sheet by sandwiching an upper surface and a lower surface of an electrically conductive polymer having a PTC characteristic with metallic foils having a pattern formed thereon, and integrating them by thermal-compression forming;

forming a protective coating, also serving as plating resist, on an upper and a lower surface of said integrated sheet, said protective coating formed at a temperature below a melting point of said electrically conductive polymer;

providing at least one opening in said sheet having said protective coating, serving also as plating resist, formed thereon;

forming an electrode by electrolytic plating on said sheet provided with said opening; and dividing said sheet having said electrode formed thereon into individual pieces, wherein said forming a protective coating, providing an opening, and forming an electrode, all conducted at a processing temperature not exceeding the melting point of said electrically conductive polymer.

13. A method of manufacturing a chip PTC thermister comprising in sequence:

forming a sheet by sandwiching an upper surface and a lower surface of an electrically conductive polymer having a PTC characteristic with metallic foils, and integrating them by thermal-compression forming;

forming a pattern by etching said metallic foils on an upper surface and a lower surface of said integrated sheet;

forming a protective coating, also serving as plating resist, on the upper and the lower surfaces of said sheet having the pattern formed thereon, said protective coating formed at a temperature below a melting point of said electrically conductive polymer;

providing at least one opening in said sheet having said protective coating, serving also as plating resist, formed thereon;

forming an electrode by electrolytic plating on said sheet provided with said opening; and dividing said sheet having said electrode formed thereon into individual pieces, wherein said forming a protective coating, providing an opening, and forming an electrode, all conducted at a processing temperature not exceeding the melting point of said electrically conductive polymer.

* * * * *